US007275756B2

(12) United States Patent
Turner et al.

(10) Patent No.: US 7,275,756 B2
(45) Date of Patent: Oct. 2, 2007

(54) SKI AND METHOD OF MANUFACTURING THE SKI

(75) Inventors: Peter Turner, Evergreen, CO (US); Mark S. Soderberg, Evergreen, CO (US); Robert Burns, Littleton, CO (US)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 721 days.

(21) Appl. No.: 10/398,521

(22) PCT Filed: Oct. 9, 2001

(86) PCT No.: PCT/US01/31602

§ 371 (c)(1),
(2), (4) Date: Nov. 17, 2003

(87) PCT Pub. No.: WO02/28491

PCT Pub. Date: Apr. 11, 2002

(65) Prior Publication Data

US 2007/0018431 A1 Jan. 25, 2007

Related U.S. Application Data

(60) Provisional application No. 60/238,725, filed on Oct. 6, 2000.

(51) Int. Cl.
*A63C 5/00* (2006.01)

(52) U.S. Cl. ..... 280/610

(58) Field of Classification Search ..... 280/610, 280/601, 608, 607, 609; 441/68; 428/116
See application file for complete search history.

(56) References Cited

U.S. PATENT DOCUMENTS

| | | | | |
|---|---|---|---|---|
| 2,851,277 | A | 9/1958 | Holmberg et al. | |
| 3,145,998 | A | 8/1964 | Holmberg et al. | |
| 3,272,522 | A | 9/1966 | Kennedy, III | |
| 3,416,810 | A | 12/1968 | Kennedy, III | |
| 3,612,556 | A | 10/1971 | Seawell | |
| 3,635,482 | A | 1/1972 | Holman | |
| 3,733,380 | A | 5/1973 | Ishida | |
| 3,762,734 | A | 10/1973 | Vogel | |
| 3,790,184 | A | 2/1974 | Bandrowski | |
| 4,068,861 | A * | 1/1978 | Zemke, Jr. | 280/610 |
| 4,233,098 | A | 11/1980 | Urbain | |
| 4,382,610 | A | 5/1983 | Arnsteiner | |
| 4,455,037 | A * | 6/1984 | Pilpel et al. | 280/610 |
| 4,655,473 | A | 4/1987 | Muller et al. | |
| 4,671,529 | A | 6/1987 | LeGrand et al. | |
| 4,706,985 | A | 11/1987 | Meatto | |
| 4,731,038 | A * | 3/1988 | Hancock et al. | 441/68 |
| 4,781,395 | A | 11/1988 | Fischer | |
| 4,858,945 | A | 8/1989 | Kashiwa | |
| 5,056,807 | A | 10/1991 | Comert et al. | |

(Continued)

*Primary Examiner*—J. Allen Shriver
(74) *Attorney, Agent, or Firm*—Collard & Roe, P.C.

(57) ABSTRACT

A method of manufacturing a ski in which bonding portions join non-metal side members (20) and a metal sheet (18) to form a cap preform section. The cap preform section is pressed downward against the top surface of a core (14) and heat is applied to bond the cap preform section to the core (14). The bonding portions include bonding strips (22) formed of a thermoplastic material that becomes adhesive when subjected to pressure and heat at a sufficiently high temperature.

21 Claims, 4 Drawing Sheets

U.S. PATENT DOCUMENTS

| | | | | | |
|---|---|---|---|---|---|
| 5,236,217 | A | | 8/1993 | Provence | |
| 5,251,924 | A | | 10/1993 | Nussbaumer | |
| 5,280,943 | A | | 1/1994 | Commier et al. | |
| 5,292,148 | A | | 3/1994 | Abondance et al. | |
| 5,372,370 | A | | 12/1994 | Rohrmoser | |
| 5,496,053 | A | | 3/1996 | Abondance | |
| 5,580,078 | A | * | 12/1996 | Vance | 280/608 |
| 5,851,331 | A | | 12/1998 | Grenetier et al. | |
| RE36,453 | E | * | 12/1999 | Abondance et al. | 280/609 |
| 6,059,308 | A | | 5/2000 | Baudin et al. | |
| 6,113,126 | A | * | 9/2000 | Zanco et al. | 280/610 |
| 6,183,000 | B1 | | 2/2001 | Piatti | |
| 6,193,244 | B1 | * | 2/2001 | Vance | 280/14.22 |
| 6,237,932 | B1 | * | 5/2001 | Zanco et al. | 280/602 |
| 6,478,917 | B1 | * | 11/2002 | Magoni et al. | 156/245 |
| 2004/0135347 | A1 | * | 7/2004 | Marion | 280/610 |
| 2005/0167948 | A1 | * | 8/2005 | Riepler | 280/610 |
| 2007/0018431 | A1 | * | 1/2007 | Turner et al. | 280/610 |

* cited by examiner

SKI AND METHOD OF MANUFACTURING THE SKI

RELATED REFERENCES

This application claims priority benefit of U.S. Provisional Ser. No. 60/238,725 filed Oct. 6, 2000.

BACKGROUND OF THE INVENTION a) Field of the Invention

The present invention relates to a snow ski, and more particularly to a composite snow ski and a method of making the same. More particularly, this relates to a composite snow ski having a desired balance of design characteristics, and also an improved manufacturing process for making the ski.

b) Background Art

Various materials can be used in the manufacture of snow skis, and various designs have been proposed, which incorporate metal components as part of the structure of the ski, and in some cases using the metal to form some of the primary components of the ski structure. One such design that has become commercially successful is disclosed in U.S. Pat. No. 4,858,945 (Kashiwa). In that particular design, the ski has a top metal cap having a top horizontal portion and two downwardly extending side portions forming at the outside side surfaces of the ski. In addition, there is a lower metal sheet above the running surface and below the wood core of the ski. This design has been demonstrated to provide a certain number of advantages which are disclosed in the text of the U.S. patent. Among these is that there is improved torsional resistance, desired weight distribution, also a desirable flexural characteristics, and others.

In addition to this, there is shown in the prior art various proposed designs incorporating metal components one way or another, and a search of the patent literature discloses a number of these.

U.S. Pat. No. 5,292,148 (Abondance et al.) shows a ski with an upper surface 3, which is secured to side elements 8.

U.S. Pat. No. 5,280,943 (Comier) shows a ski, the various layers of which are shown in FIG. 21. Layers 101, 102, and 103 may be formed of metal according to column 6, lines 26+.

U.S. Pat. No. 5,251,924 (Nussbaumer) shows a ski that is formed in a trough like mold 9, and cover 10. There is a metal upper cover layer 4, and a coated lower layer 5. The components appear to be united with resin like elements in the mold.

U.S. Pat. No. 4,781,395 (Fischer) shows a ski that is formed in a trough like mold 9, and cover 10. There is a metal upper cover layer 4, and a coated lower layer 5. The components appear to be united with resin like elements in the mold.

U.S. Pat. No. 4,731,038 (Hancock et al.) shows a mold 70, and cover 82, in which material including deck element 3, an inner plate 4, which may be of aluminum are placed with other parts.

U.S. Pat. No. 4,671,529 (LeGrand et al.) shows a ski in which there are bearing layers 3 and 4 that are formed of aluminum.

U.S. Pat. No. 4,655,473 (Muller et al.) shows the fabrication of a ski in which parts not mentioned in column 3, lines 17 to 40, may be of steel or other materials.

U.S. Pat. No. 4,382,610 (Arnsteiner) shows a ski in which layers 2 and 6 are formed of aluminum.

U.S. Pat. No. 4,233,098 (Urbain) shows a ski in which sheet metal layers 9 and 12 are secured to a resin core 3. The sheet metal may be tempered carbon steel according to claim 8.

U.S. Pat. No. 3,790,184 (Bandrowski) indicates in column 2, line a9, that casing 19 may be of metal or other materials.

U.S. Pat. No. 3,762,734 (Vogel) shows a ski in which the shell elements 2 and 3 may be formed of steel, to which resin materials are secured.

U.S. Pat. No. 3,733,380 (Ishida) shows a ski that is formed of resin molded around reinforcing elements 4 and 5. Reinforcing element 4 includes metal layer 4*c*, as well as other materials.

U.S. Pat. No. 3,612,556 (Seawell) shows a ski in which there are sheet aluminum elements 8 and 9.

U.S. Pat. No. 3,416,810 (Kennedy) shows a ski in which element 20 and legs 28 and 36 are formed of metal.

U.S. Pat. No. 3,272,522 (Kennedy) shows various configurations of a ski in which metal may be used as either an internal element or as a casing. The metallic elements are shown such as base 22, and associated side walls 24, there is a running surface such as 106 on the bottom. Other embodiments are shown with internal metallic structures.

U.S. Pat. No. 3,145,998 (Holmberg et al.) shows structures of a laminated ski in which the embodiment shown in FIG. 5 includes upper sheet steel element 31, which is secured to aluminum sheet 29, and covered with a layer of resin. There is a lower steel sheet 37, which is secured to aluminum sheet 35 on one side and covered on the outer surface with running element 45, also of resin.

U.S. Pat. No. 2,851,277 (Holmberg et al.) shows a ski with a core of wood or wood compositions, and provided with sheet steel elements 31 and 36 which are bonded to aluminum sheets.

SUMMARY OF THE INVENTION

The ski design of the present invention lends itself to efficient, cost effective and reliable manufacturing techniques, while providing the desired balance of the functional and structural characteristics of the end product, and also the ability to provide desired aesthetic features (i.e. cosmetics).

The present invention comprises a design of a ski where metal (in the preferred form steel) is used as a structural component or components, and in the preferred form where the ski has a metal structural sheet exposed at the top of the ski, combined with substantially non-metal side wall structural components which can, for example, be made of a plastic or fiber reinforced plastic composites. These are combined in such a way as to form a desired balance of functional characteristics of the ski, and enable desirable cosmetics in the ski. In addition, the present invention comprises a manufacturing process which also has a desired balance of advantageous features, and which is uniquely adapted to be used to make the type of ski described herein.

The ski which is manufactured by the past method of the present invention has a front to rear longitudinal axis, front and rear end portions, upper and lower surface portions, and side portions. Further, the ski comprises a main longitudinally extending body portion comprising main body components of the ski and a longitudinally extending cap portion at the upper and side surface portions of the ski.

The method comprises first making a cap preform section having a middle cap preform portion and side cap preform portions. The cap preform section comprises:

i. an elongate metal sheet which is predominantly metal and has upper and lower surfaces and side edge portions;

ii. two predominantly non-metal side members having upper and lower surfaces and inner and outer edge portions, with the inner edge portions being adjacent o the side edge portions of the metal sheet at juncture locations;

iii. two bonding portions, each being located at a related one of the juncture locations and joining a related one of the side members to an adjacent side portion of the metal sheet.

Preform main body components that correspond to the main body components of the ski are positioned at a molding location as a main body preform assembly, with upper, lower and side surfaces and lower side edges.

The cap preform section is positioned over the main body preform assembly so that the metal sheet is located over the upper surface of the main body preform assembly. Then the middle portion of the cap preform section is pressed downwardly against the top surface of the main body preform assembly and the cap preform section has its side portions pressed against the side surfaces of the main body preform assembly to form a bonding assembly. Heat is applied to cause the cap preform section of the main body preform assembly to come bonded in to a ski structure.

In the preferred form an upper mold section is pressed downwardly to press the cap preform assembly downwardly against the main body preform assembly. In the bonding assembly outer edge portions of the cap preform section extend outwardly beneath lower edge portions of the upper mold section to form edge seals to contain liquid material in the main body preform assembly.

In a preferred form, there is a lower metal sheet which is predominantly made of metal, and this is a component of the main body preform assembly. The main body preform assembly further comprises lower metal side edge members. In one arrangement, in merely extending flanges of the edge members have inner edge surfaces which are positioned adjacent to outer edge surfaces of the lower metal sheet. In another configuration, outer edge portions of the metal sheet are in overlapping relationship with the flange portions.

Also, in the manufacturing process, outer edge portions of the cap preform assembly extend beyond lower side edge locations of the ski which is formed, and the method further comprises trimming back the outer edge portions of the cap preform assembly to form the ski.

In one arrangement, each of the bonding portions of the cap preform assembly comprises an end edge portion of related one of the side members, and the side members are made of a thermoplastic material, and an adjacent edge portion of the metal sheet is pressed against the edge portion of its related side member so as to form a bond between each side member and the metal sheet.

In another currently preferred configuration, each of the two bonding portions comprises a bonding strip having an upper bonding surface. The cap preform section is made by providing a cap preform assembly comprising the metal sheet, the side members, and the bonding strip in overlapping relationship and applying heat to bond the bonding strips to the metal sheet and the side members to form the cap preform section. Desirably each of the bonding strips is made of a thermoplastic material, and the bonding assembly is subjected to pressure and heat at a sufficiently high temperature to cause each bonding strip to become adhesive, and upon cooling forms a bond with the adjacent side member and the metal sheet.

Also in a preferred form, the metal sheet and the two side members meet in edge to edge abutting relationship, and each of the thermoplastic bonding strips is heated to a sufficiently high level to create bonding, with each thermoplastic strip having a sufficiently high viscosity at the bonding temperature so that leakage does not occur through a joint formed by the metal sheet and the adjacent side member.

In one embodiment, the bonding strip extends only part way downwardly adjacent to an upper portion of its related side member. In another arrangement, each bonding strip extends downwardly along the side surface portions of its related side member to its related lower side edge portion of the main body preform assembly.

One preferred form of the bonding strip is to have an outer surface portion having a material which readily bonds to metal material forming the upper metal sheet and also to plastic material forming its related side member, and an inner surface material particularly adapted to a resin system which is incorporated in a main body preform assembly.

In one configuration, the metal sheet has two side edge surfaces, each of which is in abutting relationship against an adjacent side portion of the side member. In one arrangement the upper metal sheet is entirely flat and is positioned at an upper top surface of the ski. In another arrangement the upper metal sheet has side edge portions which extend outwardly and downwardly over an upper portion of a side portion of the main body preform assembly. In this configuration, one preferred form is that each outer edge portion of the metal sheet has a bend at a location spaced inwardly toward a center location of the metal sheet from its outer edge portion, and an part of the outer edge portion is substantially flat.

The ski made in accordance with the present invention comprises the upper cap section having a middle cap portion and side cap portions. This ski also has a main body portion comprising main body components of the ski.

The cap section has a middle cap portion and side cap portions. It comprises an elongate metal sheet which is predominantly metal and has upper and lower surfaces and side edge portions. This elongate metal sheet comprises at least part of the middle cap portion.

Further, the cap section comprises two predominantly non-metal side members having outer and inner surfaces and upper and lower edge portions, with the upper edge portions being adjacent to the side edge portions of the metal sheet at juncture locations.

There are two bonding strips, each located at a related one of the juncture locations and joining a related one of the side members to an adjacent side portion of the metal sheet.

The metal sheet, the two side members and the two bonding strips are bonded together to form a sealed cap configuration.

Within the sealed cap configuration, there is the main longitudinally extending body portion which comprises a core, a lower running surface member, and two side edge members which are bonded one to the other and also to the cap section. Also, there is a lower metal sheet positioned below the core.

The core, metal sheet, side edge members and lower surface member are bonded together and also bonded to the cap section by a resin system, and the resin system is enclosed within the cap section, with lower end edges of the side members of the cap section forming seals at lower edge portions of the main body portion.

Other features of the present invention will become apparent from the following detailed description.

DESCRIPTION OF THE PREFERRED EMBODIMENTS

It is believed that a better understanding of the present invention will be obtained by first describing the structure of the ski as an end product, and then describing the method manufacturing the same.

The overall configuration of the ski is, or may be, conventional, so that the ski has a tip portion, tail portion and intermediate portion, with the vertical thickness dimension of the ski decreasing from the central portion toward the end portions, and with the plan form of the ski having the conventional side cut.

Within the broader scope of the present invention, the term "ski" is to be interpreted to include snowboards or possibly other such products to incorporate the teachings of the present invention.

Figure 1:
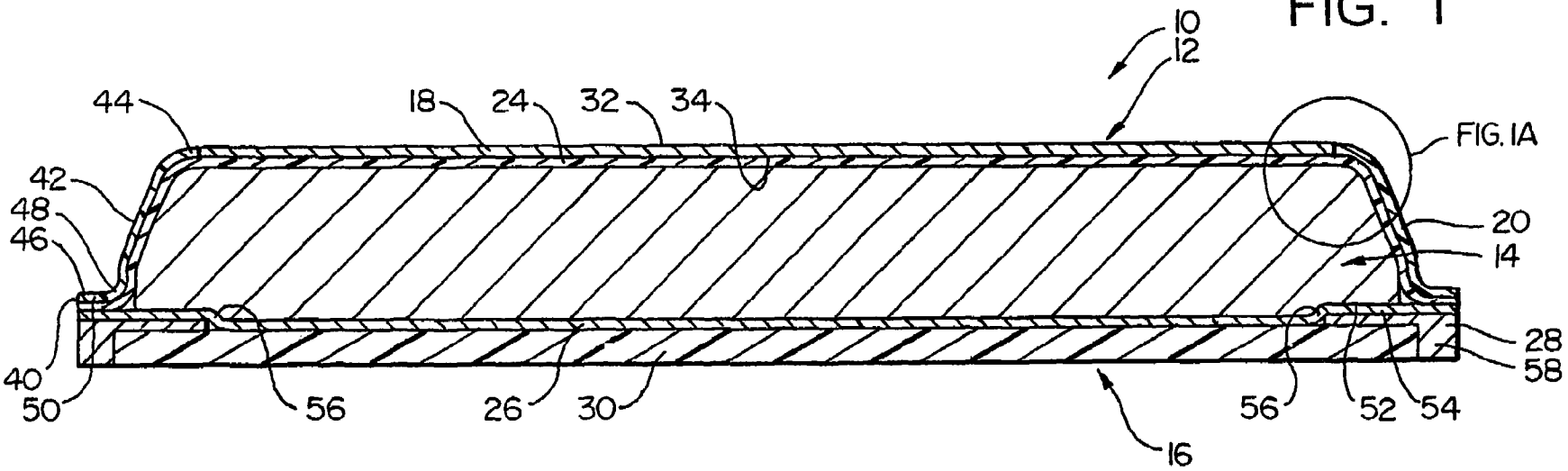
FIG. 1 is a cross-sectional view of a middle portion of the ski made in accordance with the present invention.

With reference to FIG. 1, which shows the ski at a center location in cross-section, the ski 10 can be considered as having two main structural components, namely an upper cover section 12 (i.e. cap portion or section 12), and a main body portion 13 which comprises a core section 14 and a bottom section 16.

Figure 1A:
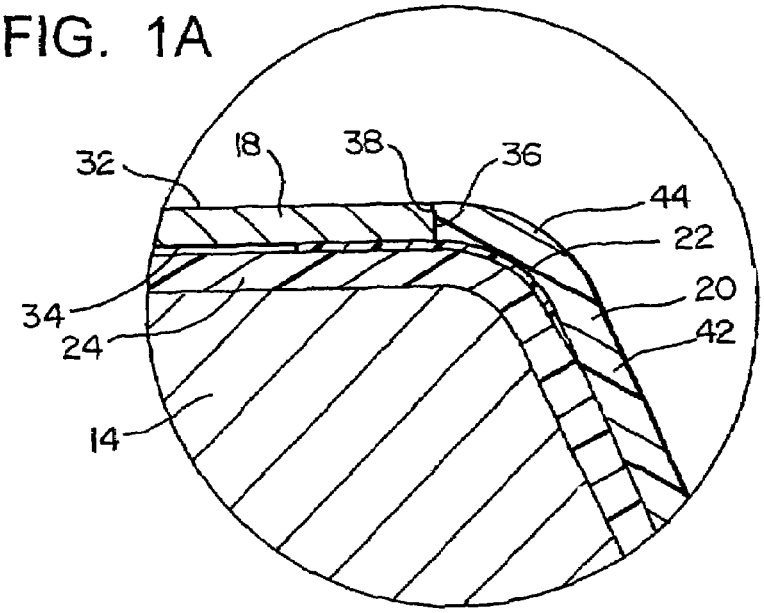
FIG. 1A is an enlarged view of an upper right corner portion which is circled in FIG. 1, showing a thermoplastic bonding film strip.

The upper cap section 12 comprises an upper metal sheet 18, a pair of side members 20, on opposite sides of the metal sheet 18, and two bonding strips 22 (shown more clearly in FIGS. 1A, 2 and 3) which join the upper metal sheet 18 to side members 20. In this particular embodiment, the bonding strips 22 are initially provided as separate strips which are bonded to adjacent portions of the upper metal sheet 18 and the side members 20. In an alternative embodiment, the bonding strips are made as part of the side members 20 in their pre-form assembly configuration. (This will be described later herein with reference to FIGS. 5A and 5B.) In addition, there is a bonding layer 24 extending beneath the metal sheet 18 and the side members 20 which joins the cover section 12 and main body portion 13.

The core section 14 is, in this preferred embodiment, made of a solid piece of wood. The bottom section 16 comprises a lower metal sheet 26 located immediately below the core section 14, and there are two steel edge members 28 located at lower side edges of the ski. Finally, there is a lowermost plastic running surface 30 immediately below the lower metal sheet 26, with outer side portions of the running surface 30 being immediately below the lower metal sheet 26 and below the inner flange portions of the edge members 28.

It is to be understood that the cross-sectional configuration shown in FIG. 1 is substantially the same cross-sectional configuration throughout the entire length of the ski, with the thickness dimension diminishing toward the end portion of the ski 10. But there could be variations or somewhat different configurations at some portion or portions of the ski (e.g. the end portions of the ski).

The two metal sheets 18 and 26 can be high strength steel, stainless steel, Titanal®, other high strength aluminum alloys such as the 7000 or 2000 series, titanium, or other high strength metals with a yield strength to modulus ratio in excess of 0.007. The metal sheets 18 and 26 are desirably entirely made of metal, including metal alloys or metal alloys having an ingredient or ingredients that technically are not a metal, but within the broader scope it may be possible to formulate a material for the sheets 18 or 26 that would incorporate other ingredients, but still be predominantly metal.

To describe these elements in more detail, the upper metal sheet 18 is, in the preferred form, high strength steel having a thickness dimension between about 0.008 to 0.020 inch, and in this embodiment about 0.015 inch. Within this range, the thickness dimension could be 0.01 inch, 0.012 inch, 0.124 inch, 0.016 inch, and 0.018. The sheet 18 has an upper surface 32, a lower surface 34 and two side edges 36 (see FIG. 1A). The upper metal sheet 18 is fully exposed to provide a desired bare metallic surface which has benefits relative both to appearance of the ski and also performance. This upper surface 32 can be provided with graphics thereon.

Each of these side members 20 is predominantly non-metal and in the preferred form is as an elongate, moderately flexible piece of plastic, such as Iso Sport's polyamide plastic ski top-sheet materials, having a thickness dimension of possibly between 0.008 to 0.030 inch, and in this embodiment about 0.024 inch. These could have other dimensional ranges, such as being as much as 0.01 inch, 0.012 inch, 0.014 inch, 0.016 inch, 0.018 inch, 0.02 inch, 0.022 inch, 0.026 inch, and 0.028 inch. Also, quite possibly this could be a greater dimension such as 0.032 inch, 0.034 inch or 0.036 inch, depending upon various other factors.

In the end configuration of the ski, each of these side members 20 has an upper inner edge 38 (see FIG. 1A) and a lower outer edge 40 (see FIG. 1). Each side member 20 extends the entire length of the ski and comprises a main downwardly and outwardly sloping side portion 42, an upper side portion 44, and a lower side edge portion 46. The upper side portion 44 has in cross-sectional configuration a curved configuration which terminates at the upper edge 38 of the side member 20, with this upper edge 38 butting against the adjacent side edge 36 of the metal sheet 18 which in this embodiment is planar. The lower side portion 46 of the side member 20 comprises a lower curved portion 48 and a lower outwardly extending horizontal portion 50 which is located adjacent to an outer side edge portion of the lower metal sheet 26 and to its related edge member 28.

Figure 2:
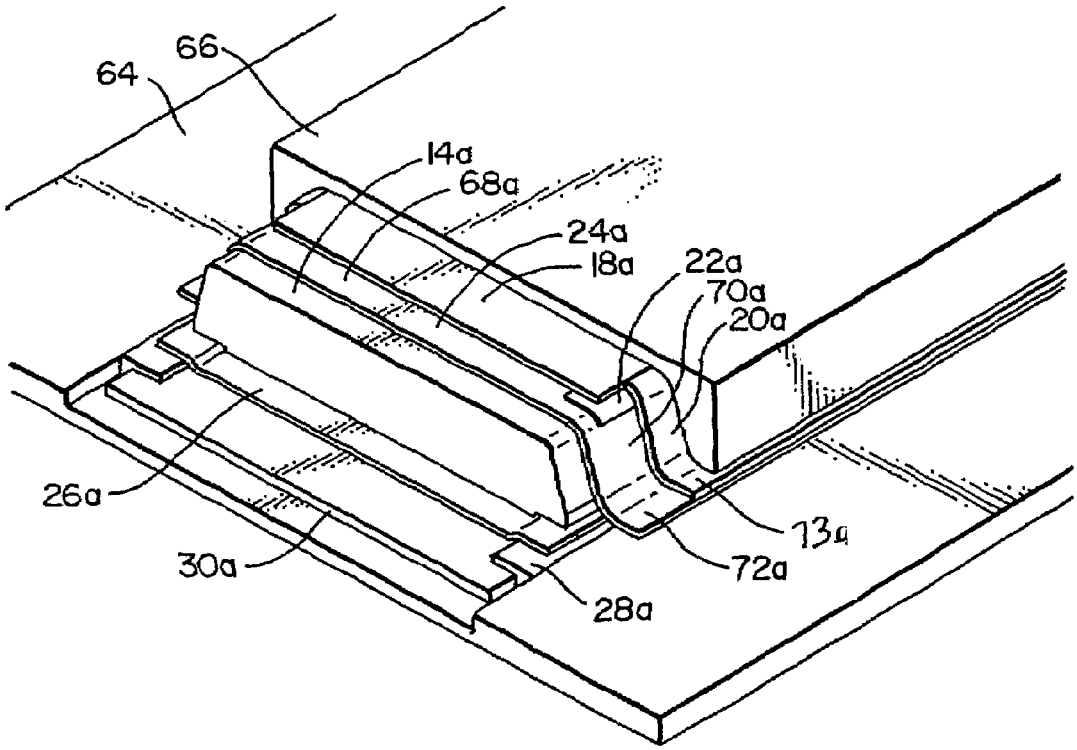
FIG. 2 is an isometric view showing the manufacturing lay-up to mold the ski of the present invention.
Figure 3:
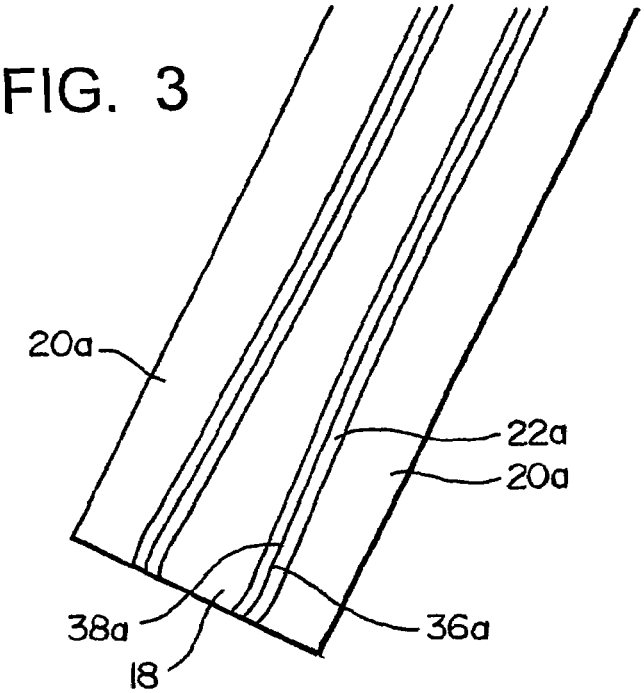
FIG. 3 is an isometric view illustrating the lay-up to form the pre-assembly of the upper metal sheet, side members and bonding strips.

Each of the aforementioned bonding strips 22, in the end configuration, is bonded to the outer lower side surface portion of the related edge portion of the metal sheet 18 and also bonded to the lower surface portion of the upper part of its related side member 20. In the preferred form, the thermoplastic bonding strip 22 is a flexible thermoplastic film adhesive that is reinforced with fiberglass. As will be described later herein, in the description of the manufacturing process, the two side members 20 and the bonding strips 22 each have the desired characteristics for being formed first into a sub-assembly (as shown in FIG. 3) and then into the final configuration of the ski (as shown in FIGS. 1 and 2), this being described later herein, with regard to the manufacturing process.

The bonding layer 24 is, in this preferred embodiment, made of fiberglass, and in the manufacturing process, a bonding resin permeates the fiberglass layer 24 to bond the metal sheet 18, the side members 20 and the adhesive strips 22 to the core section 14. This fiberglass layer 24 has, in the end configuration of the ski, a thickness dimension between about 0.006 to 0.06 inch, and within that range could have thicknesses in the ranges of 0.01, 0.02, 0.03, 0.05, and a dimension or dimensions between any pair of these values.

The core section 14 is, or may be, of conventional design and is shaped to match the overall contour of the ski. Thus, it can be seen that in cross-section the core section 14 has a trapezoidal configuration with the side surfaces sloping downwardly with a steep outward slant which is between about 70° to 75° or 80° from the horizontal, and at the lower edge portions, has cut-outs 52 to accommodate the flange portions of the edge members 28.

To describe in more detail the components of the bottom section 16, the lower metal sheet 26 is made of high-strength steel (as is the upper metal sheet 18) having a thickness dimension between about 0.008 to 0.020 inch and in this embodiment about 0.012 inch. Depending upon various factors, this thickness of the lower metal sheet 26 could be (as with the upper middle sheet 18) 0.01, 0.012, 0.014, 0.016, and 0.018 inch. In this embodiment, the lower metal sheet 26 has its outer edge portions raised slightly as at 54, the raised portions being formed by a small connecting step portion or joggle 56, this being done to accommodate the inner flanges 57 of the steel edges 28. Alternatively, the joggled portions 54 could be eliminated and the outer edges of the steel sheet 26 could terminate at the inner edges of the flanges. This will be described later herein with reference to FIG. 7.

The steel edges 28 are, or may be, of conventional design, and as show herein, there is the main outer rectangular edge portion 58 and, as indicated previously, an inwardly extending flange portion 57 by which the steel edge members 28 are mounted.

Finally, there is the aforementioned plastic running surface 30 which is, or may be, of conventional design, bonded to the bottom surface of the lower metal sheet 26. This plastic running surface extends between the inwardly facing surfaces of the outer edge portions 58 of the edge members 28.

To describe now the manufacturing process of the present invention, reference is initially made to FIG. 3, which shows the layup of the cap pre-form assembly, designated 59. The manufacturing process of this first embodiment is essentially a two-step operation. The first step is to form a cap pre-assembly 59 (or pre-form assembly 59) which is made up of three elements which, in the final configuration of the ski, are the upper metal sheet 18, the two side members 20, and the two bonding strips 22. The bonding strips 22 may be reinforced with woven or non-woven fabric as two separate pieces or a pre impregnated material. For clarity in describing the manufacturing process, these three elements, 18, 20 and 22, will, in the description of the manufacturing process, be given "a" suffixes, so that these will be designated 18*a*, 20*a* and 22*a*, respectively, and the other components or elements related to this pre-assembly will also have "a" suffixes. In FIG. 3, the lateral edges 60*a* of the side members 20*a* are shown as having a straight-line configuration. These lines 60*a* can also have a curved configuration so as to follow the contours of the outer edges 36*a* of the top metal sheet portion 18*a*. Since these components 18*a*, 20*a*, and 22*a* form the cap pre-assembly which becomes the cap section 12 in the final ski configuration, the cap pre-assembly shall be designated 12*a*.

To form this cap pre-assembly 12*a*, the metal sheet 18*a* is laid on a flat surface, and the two side members 20*a*, in the form of flat strips of plastic material, are laid on opposite sides of the side edges 36*a* of the metal sheet 18*a*, so that the edges 38*a* of the two side members 20*a* abut against the side edges 36*a* of the metal sheet 18*a*. Then the two bonding strips 22*a* are each laid over a related juncture line of the abutting edges 36*a*-38*a*, so that each of the bonding strips 22*a* has inner and outer bonding sections 61*a* and 62*a*.

Then heat is applied to the bonding strips 22*a* in a conventional manner, such as by pressing a heated surface of a platen against the two bonding strips 22*a*. This film adhesive can be a thermoplastic material so that it is flexible in the subassembly and has limited flow (i.e. controlled flow) during the subassembly manufacturing to prevent flow of adhesive onto the metal top sheet. This bonding strip 22*a* has a very fast process time of typically one to three minutes since no "cure" is required like a thermoset adhesive. The bonding strip 22*a* remains substantially solid during the final assembly. Also, the plastic sidewall members 20 and bonding strips 22, with or without reinforcement, are able to readily conform to the molded ski shape.

Further, the thermoplastic material can be reinforced with higher melt temperature or higher modulus layer of a woven or unidirectional reinforcing fabric, such as fiberglass, polyester or even cotton. The additional reinforcement can also act to promote bonding adhesion of the pre-form cap assembly 12*a* during the final ski assembly. It also prevents the material of the side members 20 from pulling apart from the metal sheet 18 during mold closing and also during the period of final assembly cure pressure and temperature.

Further, it will be noted, with reference to FIG. 2, that the lower outer portion of each side member 20*a* are sized so that the lateral edges 65*a* protrude beyond the molding surface of the ski footprint, as indicated at 62*a* (see FIG. 2), so as to force all excess resin from final assembly away from the ski. This is in contrast to a net-formed metal cap where the adhesive is able to run up along the side of the ski.

To describe the second step in the manufacturing process of this first embodiment (i.e., molding of the final assembly to bond all of the components together), reference is made to FIG. 2.

As shown in FIG. 1, there is a mold base 64 and a mold lid 66, with these two mold components 64 and 66 having mold surface contours corresponding to the configuration of the final ski. Initially, the plastic running surface 38*a* and the two edge members 28*a* are positioned in the mold base. As is commonly accomplished in the prior art, the two edge members 28*a* can be initially pre-bonded to the running surface 30*a* and then placed in the mold base 64.

Next, an adhesive layer is placed on top of the running surface 30*a* and upper surface portions of the edge members

28*a*, and the lower metal sheet 26*a* is put in place. Alternatively, instead of applying the adhesive directly, the adhesive can be formed in an impregnated layer of fabric, fiberglass or some other material (e.g., Kevlar, woven or non-woven polyester, etc.) and this adhesive layer placed on top of the running layer 30*a* and the upper surface portions of the edge members 28*a*.

Next, an adhesive material is applied to the upper surface of the lower metal plate 26*a* and then the core member 14*a* is put in place. Again, it may be possible to place a layer of fabric between the metal sheet 26*a* and the core member 14*a* or have the fabric be adhesive impregnated, or with the adhesive being applied to the layer of fiber or fabric.

With the core member 14*a* in place, the aforementioned bonding layer 24*a* (e.g., a fiberglass bonding layer 24) is placed over the core member 14*a* so that the fabric has an upper portion 68*a* on top of the core member 14*a*, two side portions 70*a* that extend downwardly along the sides of the member 14*a*, and finally two outwardly and laterally extending portions 72*a* which extend beyond the edge members 20*a* and over an adjacent surface portion of the mold base 64. A liquid adhesive material could be applied to this bonding layer 24*a*, or (as mentioned earlier) this layer 24*a* could be an adhesive impregnated layer.

As a final step, the cap pre-form assembly 12*a* (made up of the metal sheet 18*a*, the side members 20*a*, and the bonding strips 22*a*), is placed as a unit 12*a* on top of the bonding sheet 24*a*. The outer portions (comprising the side members 20*a*) of this sub-assembly 12*a* are manually moved downwardly over the sides of the other components which are already in place in the mold base 64, and then the mold lid 66 is moved downwardly to press the components into their proper position. During the molding process, if there is an outward flow of liquid material (e.g. resin or other bonding agent material), this flow will be outwardly beneath the outer layer portions 72*a* and 73*a*.

After the molding process is completed and after the bonded ski assembly is removed from the mold, then the outer edge portions formed by the members 72*a* and 73*a* are ground off.

To discuss further some facets of the method of the present invention, the temperature at which the cap pre-form assembly 12*a* is bonded is sufficiently high so that each bonding strip 22 becomes "sticky enough" so that it would bond to both of the components (i.e. the upper metal sheet 18*a* and also the side member 20*a*). The temperature at which the thermal plastic bonding strip 22 becomes sufficiently "sticky" so as to be able to bond the components 18*a*, 20*a* and 22*a* to be bonded is higher than the temperature which the entire pre-form assembly shown in FIG. 2 is subjected during the final molding process.

Also, it is to be understood that while the thermoplastic material is desirable for being used in the bonding strip 22, it would be possible to utilize a thermoset plastic (or some other material) which would have an adhesive surface that would adhere to both the metal sheet 18*a* and the side member 20*a*. Present inquiries by the applicants have not identified an adhesive material which they believe would be adequate for this particular application, but on the assumption that such adhesive materials are available and are found reliable, these could be considered for use as the bonding strip 22.

Also, the thermoplastic material which comprises the bonding strip 22 should have a sufficiently high viscosity at the bonding temperature so that it would not become sufficiently liquid to leak through the joint 36/38.

There are various advantages in using the combination of the upper metal sheet 18 and the side members 20 made of a non-metal material such as a plastic material. Functionally, as indicated previously, the upper metal sheet 18 clearly serves as a structural member. It has a high strength-to-weight ratio and it also adds to the torsional resistance of the ski. Also, this particular arrangement of having the outer edges of the metal sheet 18 terminate at a location spaced from the lower edge benefits in the manufacturing process. It is more difficult to maintain the tolerances of the edge of the metal sheet within close limits, especially when there is a bend in the metal. By using the plastic sidewall member 22, the tolerance problem is in large part removed.

Further, there is another benefit in using the plastic material or similar material as the side members 20. If there is an impact on the ski (e.g. the lower steel edge 28 striking a rock), the plastic sidewall 20 is able to absorb the shock and not delaminate from the wood core 14.

It should also be noted that the formation of the pre-form assembly 12*a* being formed first and then being placed on the final pre-form assembly, is that the bonded cap pre-form assembly 12*a* functions as a liquid-tight assembly which, in the final assembly of FIG. 2, substantially encloses the rest of the components and leaves as an exit area the two seams that are formed at the very lower edge portions of the final pre-assembly at the edge locations 50 of the side members 22. Also, as can be seen in the pre-form of FIG. 2, the resin (or possibly other liquid material, if any) which is extruded out of the pre-form assembly necessarily travels underneath the outer edge portion 73*a* of the side member 20 so that it does not come in contact with the ski.

Figure 4:
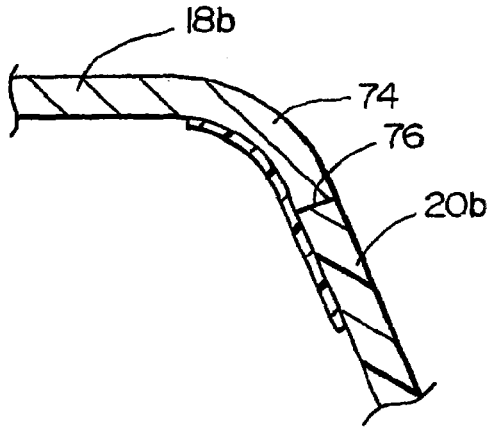
FIG. 4 is a cross-sectional view similar to FIG. 1A, showing a modified form of the pre-form assembly used in the present invention.

A second embodiment of the present invention is shown in FIG. 4. Components of the second embodiment which are similar to components of the first embodiment will be given like numerical designations with a "b" suffix distinguishing those of the second embodiment. As shown in FIG. 4, there is the upper metal sheet 18*b* and the two side members 20*b*. The upper metal sheet 18*b* has its edge portion formed in a downward curve as at 74 so that there is a juncture line 76 with the side edge 20*b* which has at that juncture location a planar configuration. This arrangement of the upper metal, sheet gives the ski a greater torsional resistance. This outer curved edge portion 74 can be formed by hydro-forming or other metal die forming operations.

Figure 5A:
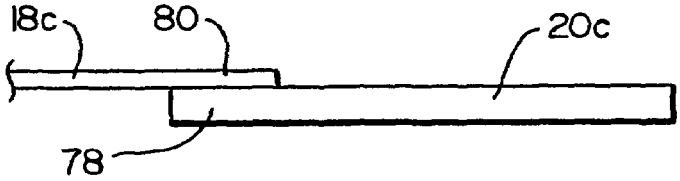
FIG. 5A is a cross-sectional view showing a modified pre-form assembly, with an edge portion of the upper metal sheet and a thermoplastic side member in an initial position in providing the pre-form.
Figure 5B:
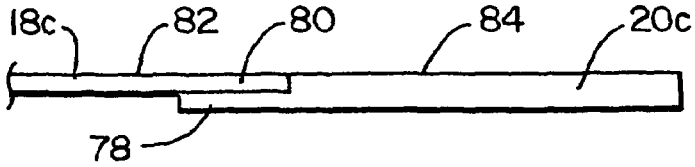
FIG. 5B is a view similar to 5A but showing the pre-form after the heat is applied to form the pre-form assembly.

A third embodiment is illustrated in FIGS. 5A and 5B. Components of this third embodiment which are the same as or similar to components of the earlier two embodiments will be given like numerical designations with a "c" suffix distinguishing those of the third embodiment. The upper metal sheet 18*c* is the same as the sheet 18 but the side member 20*c* differs. Each side member 20*c* is made as a thermoplastic layer with an inner portion 78 of this thermoplastic layer being beneath an outer edge portion 80 of the metal sheet 18*c* in the cap pre-form assembly 12*a*. As the heat is applied, the metal plate portion 80 becomes depressed into the inner portion 78 of the softened thermoplastic layer 20*c* to squeeze down the edge portion 78. At the completion of the formation of the pre-form assembly the upper surface 82 of the metal sheet 18*c* lies in the same plane as the main upper surface portion 84 of the side member 20*c*. Then the pre-form assembly in each of these modifications (FIG. 4, and FIGS. 5A and 5B) are molded into the final ski configuration as described previously.

Figure 6:
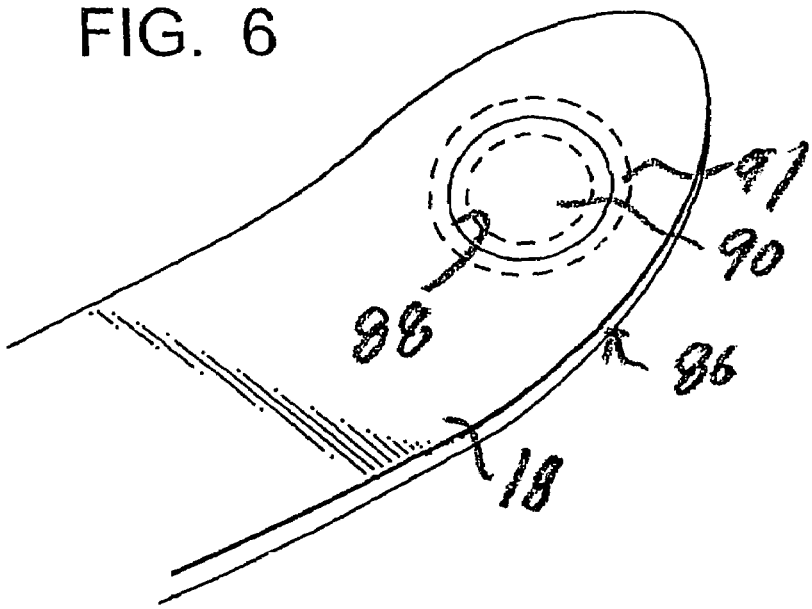
FIG. 6 is an isometric view illustrating the top surface of forward portion of the ski, with a portion of the metal sheet being cut away and a component placed in the cutout for tuning the ski (e.g. dampening) and/or cosmetics.

To describe a modified form of the present invention, reference is made to FIG. 6 which shows a front end tip portion of the ski at 86. For cosmetic reasons or to tune the dynamic performance (e.g. vibration dampening), it may be desirable to provide a cut out in the top metal sheet 18. In FIG. 6 there is a cut out at 88 in the ski tip portion of the upper metal sheet 18. The region of the cut out 88 (shown herein as a circular cut out) could be patched with a piece of the same material as is used to making the side member 20 (this material being indicated at 90) along with a bonding layer made of the same material as the bonding strip 22. The edge portion of this bonding layer 90 is shown as an edge portion 86 surrounding the cut out 82, it being understood that this adhesive 86 would extend also beneath the patched portion 90.

Figure 7:
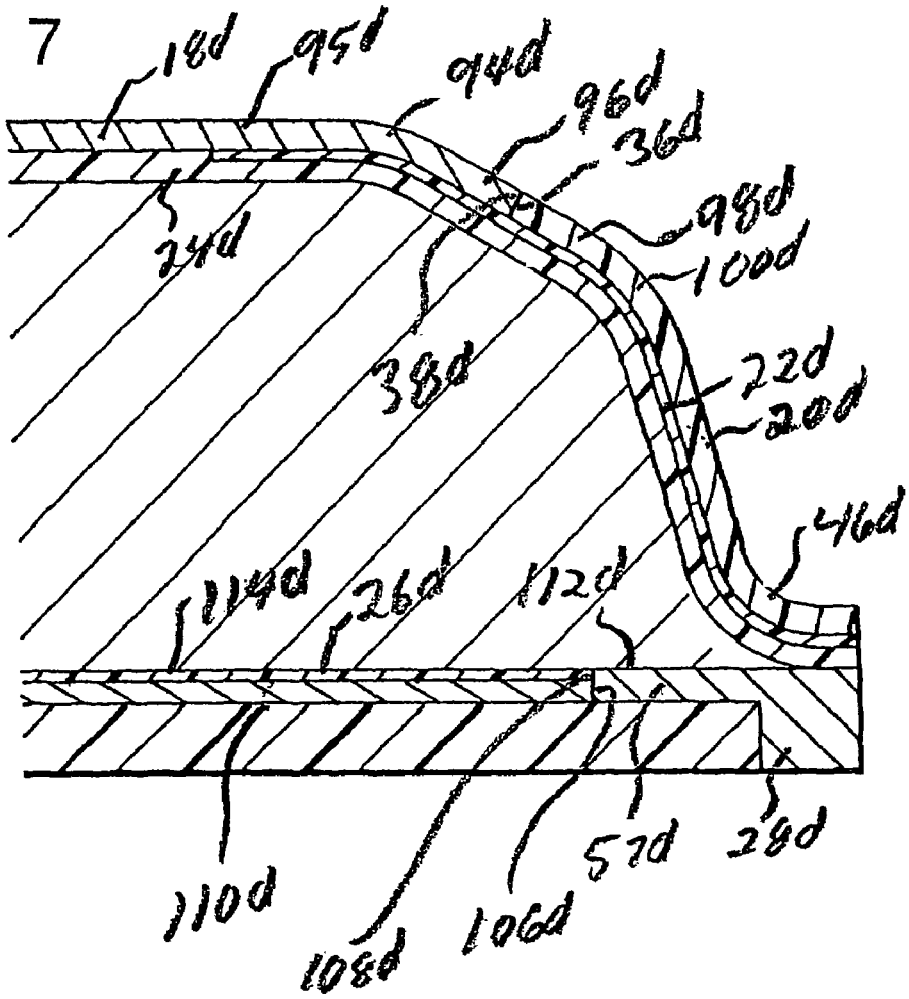
FIG. 7 is a cross-sectional view of a third embodiment of the present invention, showing an edge portion of the ski of the third embodiment drawn to an enlarged scale.

A fourth embodiment of the present invention is illustrated in FIG. 7. Components of this fourth embodiment which are similar to (or the same as) components of the prior embodiments will be given like numerical designations, with a "d" distinguishing those of the fourth embodiment. There are three main distinctions between the fourth embodiment and the first embodiment. The first is that configuration of the components at the upper outer edge portion of the final pre-form and the finished ski is modified from what is shown in FIG. 1. The second is that the bonding strip 22*d* is extended so that it extends entirely down the inside of its related sidewall 20*d* and all the way to the outer edge portion of the pre-form assembly, so that it would be extending between the outer edge portion 73*a* and 72*a*, as shown in FIG. 2. The third is the lower metal sheet 26*d* has its outside edge terminate adjacent to the inner edge 57*d* of the edge member 28*d*.

Let us turn our attention now to the first item listed in the paragraph immediately above. It will be noted that the upper metal sheet member 18*d* is formed with a longitudinally aligned bend at 94*d* adjacent to an outer edge portion 95*d* of the middle planar portion of the metal sheet 18*d*. Then immediately outwardly of the rounded portion 94*d*, there is a flat outer sheet metal portion 96*d* which terminates at the juncture location 36*d*/38*d*. Then from the juncture location 36*d*/38*d*, the side member 22*d* begins as a planar portion 98*d* which leads from its edge 38*d* and transitions into a longitudinal curved portion 100*d*, which in turn leads into a downwardly extending portion 102*d*. Then the lower end of the planar portion 102*d* leads into the outer edge portion 46*d* which is substantially the same as the portion 46 in the first embodiment.

The second item in this fourth embodiment that differs from the first embodiment is, as indicated above, that the bonding strip 22*d* extends all the way from the beneath the outer edge portion of the metal sheet 18*d* all the way down along the side of the ski, and then extends laterally outwardly as show in FIG. 7. Thus, the bonding strip 22*d* simply follows the contour of the metal strip portions 95*d*, 94*d*, and 96*d*, and from there follows the contours 98*d*, 100*d*, 102*d*, and 46*d* of the side member 20*d*.

As indicated previously, the third item in this fourth embodiment that differs from the first embodiment in that the lower metal sheet 26*d* terminates at a further inward location than in the first embodiment. More specifically, the outer side edge 106*d* of each side of the lower sheet 26*d* terminates adjacent to the inwardly facing edge 108*d* of the flange 57*d*.

Since the flange 57*d* generally has a greater thickness dimension than the thickness dimension of the lower metal sheet 26*d*, there is in the preferred embodiment provided a filler material 110*d* immediately above the metal sheet 26*d* so that the upper surface 112*d* of the flange 57*d* is in the same plane as the upper surface 114*d* of the filler material 110*d*. This layer of filler material 110*d* could be a porous, woven or non-woven plastic layer impregnated with resin. This could be pre-pregged, in which case it would soften and bond, or at the time of manufacture it could be coated with a copper layer which would be bonding.

Also, the two flanges 57*d* of the steel edges 28*d* would be bonded by the upper surface 112*d* to the wood core. This could be done by applying a proper adhesive or bonding agent at the time of being placed in the mold. Also, it is possible to place other material such as a rubber or fiberglass layer between the flange 57 of each steel end 28 and the wood core 14.

The method of manufacture of the present invention would be modified from that of the first embodiment to some extent to make the ski shown in FIG. 7. More specifically, the initial pre-form operation described above with reference to FIG. 3 would be modified so this would, become a two-step operation.

The first step would be to form the pre-form substantially the same as described above with reference to FIG. 3. Thus, the metal sheet 18*d*, the side members 20*d*, and the two bonding strips 22*d* would be assembled substantially the same as in FIG. 3. However, with the bonding strips 22*d* extending further outwardly, the outer edge of the bonding strips 22*d* would reach substantially out to the outside edges 63*a* of the edge members 20*a*, as shown in FIG. 3.

After the pre-form flat layup is subjected to heat and pressure by the platen, then the bonded assembly is moved to perform a hydroforming operation where an upper molding member would be moved downwardly to engage the upper surface of the bonded pre-assembly and thus deform the outer edge portions of the metal sheet 18*d* to form the bend at 94*d* and also the outer planar section 96*d*. The side members 20*d* would also be deformed downwardly. In a preferred form, the angle of the planar portion 96*d* would also make an angle of about one-third of a right angle with the main horizontal portion of the metal sheet 18*d*. Then the bonded pre-form, with the bends made in the outside metal sheet portions, is moved over to the final assembly, and in the final molding operation, the outwardly extending side portions 20*d* would be moved downwardly to press against the sidewalls of the core 14*d*.

In other respects, the manufacturing operation to make the ski of the fourth embodiment would be substantially the same as described above, and in the final molding operation the finished ski product is formed.

It has been found that the hydroforming step described above could be accomplished more effectively by placing a layer of nylon about one-eighth inch thick between the softer hydroforming material and the upper surface of the pre-assembly. This allows proper forming, and would prevent possible rupturing of the joints of the metal sheet 18*d* and the side members 20*d*.

A further aspect of the present invention is that the bonding strips 22*d* could be formed in a particular manner to enhance its functions. More specifically, the bonding strip 22/22*d* of both the first and second embodiments could be made with an outer surface (i.e. the surface that faces the side members 20 and the metal sheet 18) is made of a material that bonds well to both steel and polyamide (the material with which the side members 20 are made). This layer could be, for example, about 0.01 inch. Then there would be an inner surface thermal plastic layer that bonds well to epoxy resin systems that are used in the final molding of the ski. Such a poly resin system is available from Sarna (a Swiss company). This also could be made with a thickness dimension of 0.01 inch or thinner. The middle portion of the material forming the bonding strip 22/22*d* could be made of a thermoplastic material that is described above.

Another feature of the present invention is that it enables cosmetics to be conveniently applied to the side portions of the ski. For example, the middle portion of the bonding strip 22/22*d*, as described immediately above, could be provided with cosmetics, and it can be, for example, a decorative pattern made of woven fiberglass, woven fiberglass with metallic copings, or fabric with printing, etc. In this instance, the side members 20/20*d* would be substantially transparent. Another option is that the polyamide sidewall could be back-printed by conventional techniques. Also, the decorative pattern could be sublimated into the body of the sidewall 20/22 in accordance with techniques that are well known in the art.

It is obvious that various modifications could be made to the present invention without departing from the basic teachings thereof.

We claim:

1. A method of manufacturing a ski having a front to rear longitudinal axis, front and rear end portions, upper and lower surface portions, and side surface portions, said ski further comprising a main longitudinally extending body portion comprising main body components of the ski and a longitudinally extending cap portion at the upper and side surface portions of the ski, said method comprising:

a) making a cap preform section having a middle cap preform portion and side cap preform portions, and comprising:
   i. an elongate metal sheet which is predominantly metal and has upper and lower surfaces and side edge portions;
   ii. two predominantly non-metal side members having upper and lower surfaces and inner and outer edge portions, with the inner edge portions being adjacent to the side edge portions of the metal sheet at juncture locations;
   iii. two bonding portions, each being located at a related one of the juncture locations and joining a related one of the side members to an adjacent side portion of the metal sheet;
b) positioning preform main body components corresponding to the main body components of the ski at a molding location as a main body preform assembly with upper, lower and side surfaces, and lower side edge portions;
c) positioning the cap preform section over the main body preform assembly so that the metal sheet is located over the upper surface of the main body preform assembly;
d) pressing the middle portion of the cap preform section downwardly against the top surface of the main body preform assembly and pressing the cap preform section side portions against the side surfaces of the main body preform assembly to form a bonding assembly and applying heat to cause the cap preform section and the main body preform assembly to become bonded into a ski structure.

2. The method as recited in claim 1, wherein an upper mold section is pressed downwardly to press the cap preform assembly downwardly against the main body preform assembly.

3. The method as recited in claim 2, wherein in the bonding assembly outer edge portions of the cap preform section extend outwardly beneath lower edge portions of the upper mold section form edge seals to contain liquid material in the main body preform assembly.

4. The method as recited in claim 1, wherein a lower metal sheet which is predominantly made of metal is a component of the main body preform assembly.

5. The method as recited in claim 4, wherein said main body preform assembly comprises a core, and the lower metal sheet is located beneath said core.

6. The method as recited in claim 5, wherein said main body preform assembly further comprises lower metal side edge members having inwardly extending flanges with inner edge surfaces which are positioned adjacent to outer edge surfaces of the lower metal sheet.

7. The method as recited in claim 4, wherein said main body preform assembly further comprises lower metal side edge members having inwardly extending flange portions, and outer edge portions of the lower metal sheet and the inwardly extending flange portions are in overlapping relationship.

8. The method as recited in claim 4, wherein the outer edge portions of the cap preform assembly extend beyond lower side edge locations of the ski which is formed, said method further comprising trimming back the outer edge portions of the cap preform assembly to form the ski.

9. The method as recited in claim 1, wherein each of said bonding portions comprise an end edge portion of a related one of the side members, and said side members are made of a thermoplastic material, and an adjacent edge portion of the metal sheet is pressed against the edge portion its related side member so as to form a bond between side member and said metal sheet.

10. The method as recited in claim 1, wherein each of said two bonding portions comprises a bonding strip having an upper bonding surface, said cap preform section being made by providing a cap preform assembly comprising said metal sheet, said side members and said bonding strip in overlapping relationship and applying heat to bond the bonding strips to the metal sheet and the side members to form the cap preform section.

11. The method as recited in claim 10, wherein each of said bonding strips is a thermoplastic material, and the bonding assembly is subjected to pressure and heat at a sufficiently high temperature to cause each bonding strip to become adhesive, and upon cooling, forms a bond with the adjacent side member and the metal sheet.

12. The method as recited in claim 11, wherein said metal sheet and the two side members meet in edge to edge of abutting relationship, and each of said thermoplastic bonding strips is heated to a sufficiently high level to create bonding, with each thermoplastic strip having a sufficiently high viscosity at the bonding temperature so that leakage does not occur through a joint formed by the metal sheet and the side member.

13. The method as recited in claim 9, wherein each bonding strip extends downwardly along side surface portions of its related side member to its related lower side edge portion of the main body preform assembly.

14. The method as recited in claim 9, wherein each of said bonding strips has an outer surface portion having a material which readily bonds to metal material forming said upper metal sheet and also to plastic material forming its related side member, and an inner surface material particularly adapted to bond to a resin system which is incorporated in a main body preform assembly.

15. The method as recited in claim 1, wherein the metal sheet has two side edge surfaces, each of which is in abutting relationship against an adjacent side edge portion of the side member.

16. The method as recited in claim 15, wherein said upper metal sheet is entirely flat, and is positioned at an upper top surface of said ski.

17. The method as recited in claim 15, wherein said upper metal sheet has side edge portions which extend outwardly and downwardly over an upper portion of a side portion of said main body preform assembly.

18. The method as recited in claim 17, wherein each outer edge portion of the metal sheet has a bend at a location spaced inwardly toward a center location of the metal sheet from its outer edge portion, and an outer part of the outer edge portion is substantially flat.

19. The method as recited in claim 17, wherein after the metal sheet is bonded to the two side members, the resulting cap preform section is subjected to a hydro-forming operation to bend outer portions of the upper metal sheet downwardly, after which the cap preform section is placed onto the main body preform assembly to be pressed downwardly against the main body preform assembly.

20. A ski made in accordance with the method of claim 1.

21. A ski having a front to rear longitudinal axis, upper and lower surface portions, and side surface portions, said ski comprising:

a) a cap section having a middle cap portion and side cap portions, said section further comprising:

i. an elongate metal sheet which is predominantly metal and has upper and lower surfaces and side edge portions, and comprises at least part of said middle cap portion;

ii. two predominantly non-metal side members having outer and inner surfaces and upper and lower edge portions, with the upper edge portions being adjacent to the side edge portions of the metal sheet at juncture locations;

iii. two bonding strips, each being located at a related one of the juncture locations and joining a related one of said side members to an adjacent side portion of the metal sheet;

iv. said metal sheet, two side members and two bonding strips being bonded together to form a sealed cap configuration;

b) a main longitudinally extending body portion which comprises a core, a lower surface member, a lower steel sheet between said core and said lower surface member, and two side edge members which are side members, said core, lower surface member, lower metal sheet and two side members being bonded to one another and also being bonded to the cap section by a resin system;

c) said ski being characterized in that said main body section with said resin system is enclosed within the cap section, with lower edge portions of the side members of the cap section forming seals at lower edge portions of the main body portion.

* * * * *